US007967284B2

(12) United States Patent
Nagasako et al.

(10) Patent No.: US 7,967,284 B2
(45) Date of Patent: Jun. 28, 2011

(54) SHEET CONVEYING DEVICE, SHEET PROCESSING APPARATUS, AND IMAGE FORMING APPARATUS

(75) Inventors: Shuuya Nagasako, Kanagawai (JP); Masahiro Tamura, Kanagawa (JP); Nobuyoshi Suzuki, Tokyo (JP); Hiroshi Maeda, Aichi (JP); Tomoichi Nomura, Aichi (JP); Kazuhiro Kobayashi, Kanagawa (JP); Tomohiro Furuhashi, Kanagawa (JP); Makoto Hidaka, Tokyo (JP); Hitoshi Hattori, Tokyo (JP); Ichiro Ichihashi, Aichi (JP); Junichi Tokita, Kanagawa (JP); Akira Kunieda, Tokyo (JP); Naohiro Kikkawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 680 days.

(21) Appl. No.: 12/073,371

(22) Filed: Mar. 5, 2008

(65) Prior Publication Data

US 2008/0217837 A1 Sep. 11, 2008

(30) Foreign Application Priority Data

Mar. 5, 2007 (JP) ..... 2007-054308

(51) Int. Cl.
*B65H 29/60* (2006.01)

(52) U.S. Cl. ..... 270/58.01; 271/303

(58) Field of Classification Search ..... 270/45, 270/58.01, 58.07, 58.09, 58.11; 271/303
See application file for complete search history.

(56) References Cited

U.S. PATENT DOCUMENTS

| | | | | |
|---|---|---|---|---|
| 5,267,729 | A * | 12/1993 | Hirota et al. | 271/297 |
| 5,961,110 | A * | 10/1999 | Adachi et al. | 270/58.01 |
| 6,988,729 | B2 | 1/2006 | Tamura et al. | |
| 7,798,950 | B2 * | 9/2010 | Kobayashi et al. | 493/406 |
| 2005/0067777 | A1 | 3/2005 | IIda et al. | |
| 2006/0055100 | A1 * | 3/2006 | Suzuki et al. | 270/45 |
| 2007/0235917 | A1 | 10/2007 | Nagasako et al. | |
| 2009/0057978 | A1 * | 3/2009 | Maeda et al. | 270/37 |
| 2009/0152789 | A1 * | 6/2009 | Kikkawa et al. | 270/45 |
| 2009/0200725 | A1 * | 8/2009 | Tamura et al. | 270/45 |

FOREIGN PATENT DOCUMENTS

| | | |
|---|---|---|
| JP | 2001-335217 | 12/2001 |
| JP | 2003-095506 | 4/2003 |
| JP | 2006-137511 | 6/2006 |

* cited by examiner

*Primary Examiner* — Leslie A Nicholson, III
(74) *Attorney, Agent, or Firm* — Harness, Dickey & Pierce, P.L.C.

(57) ABSTRACT

A sheet conveying device in which at least a sheet is guided and conveyed by a guiding member includes a discharging roller that conveys the sheet, a first guiding member and a second guiding member that are arranged along an outer periphery of the discharging roller, and a supporting shaft that rotatably supports both the first guiding member and the second guiding member. When the first guiding member is located at a first position in which a path between the first guiding member and the discharging roller is closed, the sheet is guided to a shift conveying path, and when the first guiding member is located at a second position in which the path is opened, the sheet is guided to a folding processing tray.

10 Claims, 11 Drawing Sheets

SHEET CONVEYING DEVICE, SHEET PROCESSING APPARATUS, AND IMAGE FORMING APPARATUS

CROSS-REFERENCE TO RELATED APPLICATIONS

The present application claims priority to and incorporates by reference the entire contents of Japanese priority document 2007-054308 filed in Japan on Mar. 5, 2007.

BACKGROUND OF THE INVENTION

1. Field of the Invention

The present invention relates to a sheet conveying device, a sheet processing apparatus, and an image forming apparatus that includes the sheet processing apparatus integrally or separately.

2. Description of the Related Art

Conventional technologies are disclosed in Japanese Patent Application Laid-open No. 2003-95506 and Japanese Patent Application Laid-open No. 2001-335217. According to Japanese Patent Application Laid-open No. 2003-95506, a sheet processing apparatus in which a predetermined processing is performed with respect to sheets is disclosed. The above sheet processing apparatus includes a staple processing tray in which an alignment and staple processing is performed to a stack of sheets, a conveying path that is used to directly discharge the sheets to which the alignment and staple processing is performed in the staple processing tray, an upper and a lower conveying guide through which the sheets are conveyed on a side of a folding plate in which center folding is performed, and a branch guide plate and a movable guide plate by which a conveying path for sheets is changed between the conveying path for directly discharging sheets and the upper and the lower conveying guides. When the sheets are conveyed from the branch guide plate and the movable guide plate to the upper and lower conveying guides, the sheets are turned along an outer periphery of a discharging roller located at a most downstream of the staple processing tray to direct the sheets to the upper and lower conveying guides.

According to Japanese Patent Application Laid-open No. 2001-335217, a sheet processing apparatus that is attached to, arranged side by side with, or integrally arranged in an image forming apparatus is disclosed. The sheet processing apparatus in which a predetermined processing is performed to sheets that are discharged from an image forming apparatus and on which images are formed includes a conveying unit in which the sheets conveyed from different conveying paths are selectively conveyed to different conveying paths.

When saddle stitching or center folding processing is performed, after sheets are aligned in a sheet-conveying direction and in a sheet-width direction in a corner stapler, a conveying unit that applies a conveying force to the sheets when the sheets are conveyed to a saddle stitching processor located at a downstream is located above the corner stapler. Therefore, it is necessary not to prevent a position and control of the conveying unit from interfering with sheet alignment in the corner stapler. Moreover, to reliably convey the sheets to a sheet processor and a stack unit at a downstream by a discharging unit that pushes the sheets from the corner stapler, it is preferable to approach an operation range of the discharging unit to the stack unit as close as possible. However, a guiding member to guide the sheets to the stack unit is arranged at a downstream of the discharging unit. Therefore, when the operation range of the discharging unit is approached to the stack unit, the discharging unit may interfere with the guiding member. Thus, to convey the sheets to the stack unit without causing jam, it is necessary to approach the operation range of the discharging unit to the stack unit in addition to a configuration in which the operation of the discharging unit does not interfere with the guiding member.

SUMMARY OF THE INVENTION

It is an object of the present invention to at least partially solve the problems in the conventional technology.

According to an aspect of the present invention, a sheet conveying device that conveys a sheet, includes a guiding roller that guides and conveys the sheet, a first guiding member and a second guiding member, arranged along an outer-periphery of the guiding roller, for guiding the sheet in conjunction with the guiding roller, and a supporting shaft that rotatably supports both the first guiding member and the second guiding member.

According to another aspect of the present invention, a sheet processing apparatus, includes a staple processing tray for performing alignment and staple binding with respect to a sheet stack, a shift tray for receiving the sheet stack by keeping a position of a top surface of the sheet stack substantially constant irrespective of the number of the sheet stack thereon, a folding processing tray for performing folding to the sheet stack, and a sheet turning mechanism for guiding the sheet stack from the staple processing tray into one of the shift tray and the folding processing tray. The sheet turning mechanism includes a conveying roller for conveying the sheet stack processed by the staple processing tray, a first rotatable member and a second rotatable member, arranged along an outer periphery of the conveying roller, for guiding the sheet stack in conjunction with the conveying roller, a supporting shaft rotatably supporting both the first and the second rotatable members, and a motor for rotating the first and second rotatable members to locate at a first position in which the first and second rotatable members guide the sheet stack to the shift tray, and for rotating the first and second rotatable members to locate at a second position in which the first and second guiding members guide the sheet stack to the folding processing tray.

According to still another aspect of the present invention, an image forming system includes an image forming apparatus for forming an image on a sheet, and a sheet processing apparatus for processing the sheet output from the image forming apparatus. The sheet processing apparatus includes a guiding roller that guides and conveys the sheet output from the image forming apparatus, a first guiding member and a second guiding member, arranged along the guiding roller to form a turning conveying path between a curved inner surface of the first guiding member and the second guiding member and an outer periphery of the guiding roller, for guiding a leading edge of the sheet in conjunction with the guiding roller, and a supporting shaft that rotatably supports both the first guiding member and the second guiding member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
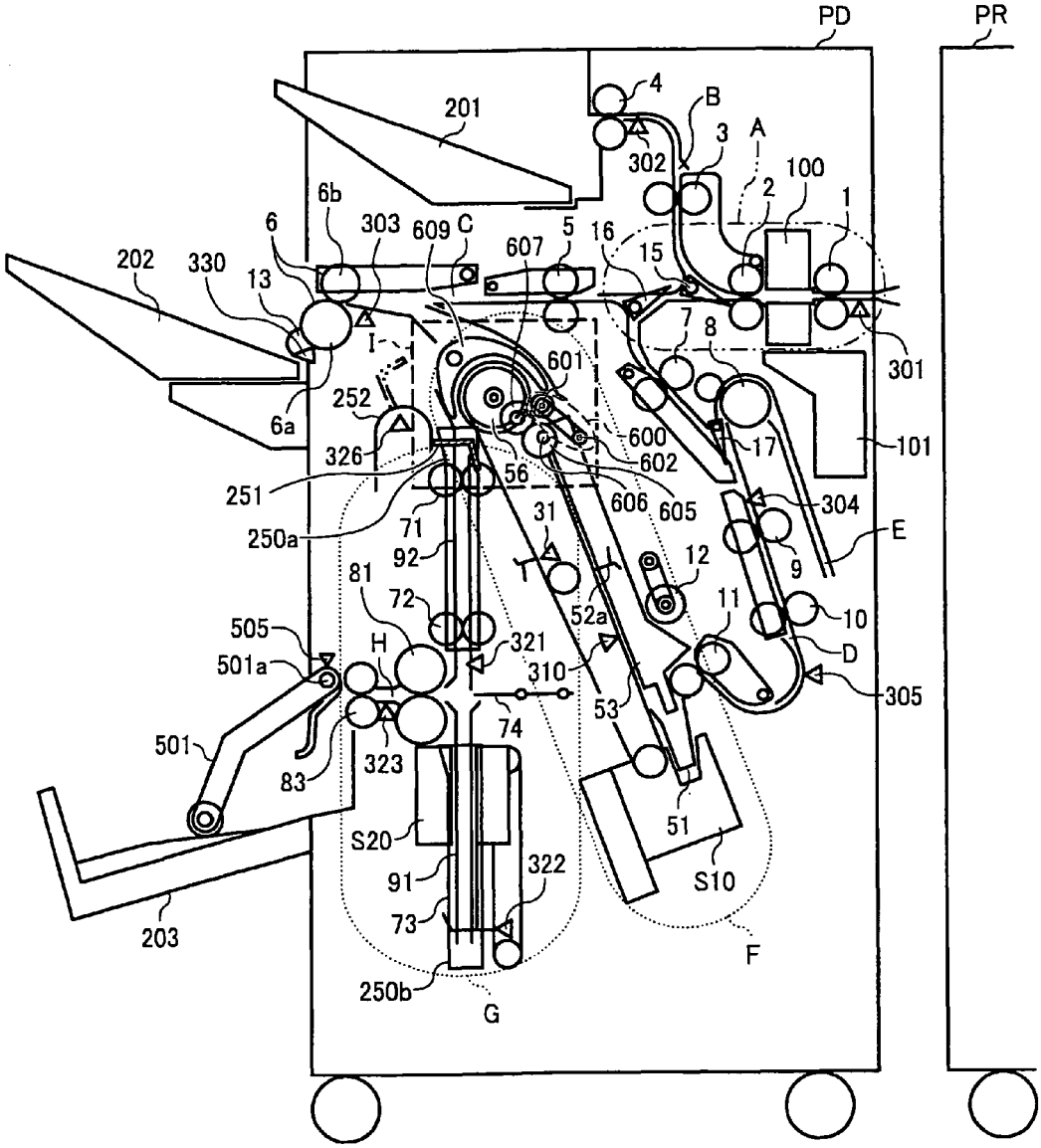
FIG. 1 is a schematic diagram of an image forming system that includes a sheet post-processing apparatus serving as a sheet processing apparatus and an image forming apparatus according to an embodiment of the present invention.

FIG. 1 is a schematic diagram of an image forming system that includes a sheet post-processing apparatus serving as a sheet processing apparatus and an image forming apparatus according to an embodiment of the present invention. The entire configuration of the sheet post-processing apparatus and part of the image forming apparatus are indicated in FIG. 1.

The sheet post-processing apparatus PD is arranged alongside the image forming apparatus PR. Sheets discharged from the image forming apparatus PR are conveyed to the sheet post-processing apparatus PD. The sheets enter a conveying path A that has a post-processing unit (a punch unit 100 in the embodiment) in which post-processing is performed to a sheet. Then, the sheets are distributed by branching nails 15 and 16 into a conveying path B that leads to an upper tray 201, a conveying path C that leads to a shift tray 202, and a conveying path D that leads to a processing tray F. In the processing tray F (hereinafter, also "a staple processing tray"), alignment and staple binding are performed to sheets.

The image forming apparatus PR (or 380 in FIG. 15) includes at least an image processing circuit (not shown) in which input image data is converted into printable image data, an optical writing device in which optical writing is performed to a photosensitive element based on an image signal output from the image processing circuit, a developing device in which an electrostatic latent image formed on the photosensitive element through optical writing is developed with toners, a transfer device in which a toner image visualized by the developing device is transferred onto a sheet, and a fixing device in which the toner image transferred onto the sheet is fixed. A sheet on which the toner image is fixed is sent to the sheet post-processing apparatus PD in which a predetermined post processing is performed. The image forming apparatus PR is explained below as an electrophotographic image forming apparatus as described above. However, the image forming apparatus PR can be of any known type such as an ink-jet image forming apparatus or a heat-transfer image forming apparatus. An image forming unit includes the image processing circuit, the optical writing device, the developing device, the transfer device, and the fixing device as described above.

The sheets are conveyed through the conveying paths A and D to the staple processing tray F in which alignment and staple binding are performed. Then, the sheets are distributed by a guiding member 609 into the conveying path C that leads to the shift tray 202 and a saddle-stitching/center-folding processing tray G (hereinafter, also "a folding processing tray") in which folding is performed to sheets. The sheets to which folding is performed in the folding processing tray G are led through a conveying path H to a lower tray 203. A branching nail 17 arranged in the conveying path D is held by a low load spring (not shown) in a state shown in FIG. 1. After a trailing edge of a sheet conveyed by conveying rollers 7 passes the branching nail 17, the sheet is reversed along a turn guide 8 by reversing at least conveying rollers 9 among conveying rollers 9 and 10 and staple discharging rollers 11, and the trailing edge of the sheet is directed to a sheet accommodating unit E in which sheets are accumulated, which enables conveyance of sheets piled with the following sheets. Repetition of this operation enables two or more piled sheets to be conveyed. The guiding member 609 can be integrally formed as one member (see FIGS. 1 and 7) or formed of a first guiding member 609*a* and a second guiding member 609*b* as two members (see FIGS. 8 and 14). The former guiding member 609 is rotatably driven by a motor M2. The latter guiding members 609*a* and 609*b* are rotatably driven by motors M2*a* and M2*b*, respectively.

The conveying path A that is arranged at an upstream of each of the conveying paths B, C, and D and that are shared by each of them includes an inlet sensor 301 that detects sheets sent from the image forming apparatus PR, inlet rollers 1 arranged at a downstream of the inlet sensor 301, the punch unit 100, a punched trash hopper 101, conveying rollers 2, and branching nails 15 and 16 that are arranged in sequence. The branching nails 15 and 16 are held by a spring (not shown) in the state shown in FIG. 1 and are driven by turning on a solenoid (not shown). The branching nails 15 and 16 cause the sheets to be directed to one of conveying paths B, C, and D by changing operational positions of the branching nails 15 and 16.

When the sheets are directed to the conveying path B, the solenoid is turned off in the state shown in FIG. 1. When the sheets are directed to the conveying path C, the solenoid is turned on from the state shown in FIG. 1. The branching nail 15 swings upward and the branching nail 16 swings downward. The sheets are discharged through conveying rollers 3 and discharging rollers 4 to the upper tray 201. When the sheets are directed to the conveying path D, the branching nail 16 is as it is shown in FIG. 1 with the solenoid turned off. The branching nail 15 swings upward by turning on the solenoid from the state shown in FIG. 1. Then, the sheets are conveyed through a pair of conveying rollers 5 and discharging rollers 6 (6*a* and 6*b*) to the shift tray 202.

Each processing can be performed with respect to the sheets in the sheet post-processing apparatus such as punching (the punch unit 100), sheet aligning and corner binding (a jogger fence 53, an corner stapler S10), sheet aligning and saddle stitching (a saddle-stitching upper jogger fence 250*a*, a saddle-stitching lower jogger fence 250*b*, and a saddle stitching stapler S20), sheet sorting (the shift tray 202), and center folding (a folding plate 74 and folding rollers 81).

As shown in FIG. 1, a shift tray discharging unit located at a most downstream of the sheet post-processing apparatus PD includes the discharging rollers 6 (6*a* and 6*b*), a return roller 13, a sheet-surface detecting sensor 330, the shift tray 202, a shift mechanism (not shown) that reciprocates the shift tray 202 in a direction vertical to a sheet conveying direction, and a shift tray up-and-down mechanism that moves the shift tray 202 up and down.

The return roller 13 made of sponge comes into contact with sheets discharged from the discharging rollers 6 and is used to align the sheets by hitting trailing edges of the sheets to an end fence. The return roller 13 rotates based on a rotating force of the discharging rollers 6. A tray rise limit switch is arranged near the return roller 13. When the shift tray 202 rises and the return roller 13 is pressed, the tray rise limit switch is turned on and a tray elevation motor stops. Thus, the shift tray is prevented from moving beyond an allowed limit. As shown in FIG. 1, the sheet-surface detecting sensor 330 serving as a sheet-surface position detecting unit that detects a sheet-surface position of a sheet or a stack of sheets discharged on the shift tray 202 is arranged near the return roller 13.

The sheet-surface detecting sensor (for stapling) and the sheet-surface detecting sensor (not for stapling) are turned on when they are shielded by a shield unit. Thus, when the shift tray 202 ascends and a contact portion of a sheet-surface detecting lever rotates upward, the sheet-surface detecting sensor (for stapling) is turned off. When the contact portion of the sheet-surface detecting lever rotates furthermore upward, the sheet-surface detecting sensor (not for stapling) is turned on. When the sheet-surface detecting sensor (for stapling) and the sheet-surface detecting sensor (not for stapling) detect that sheets stacked on the shift tray 202 reaches a predetermined height, the shift tray 202 descends by a predetermined distance based on driving of the tray elevation motor. This makes it possible to keep a position of a surface of a sheet or top one of sheets substantially constant irrespective of the number of sheets on the shift tray 202.

The sheets are sent to the staple processing tray F by the staple discharging rollers 11 and are stacked in sequence on the staple processing tray F. In this case, the sheets are aligned for each sheet in a longitudinal direction (in a direction of conveying sheets) by a tapping roller 12 and in a lateral direction (in a direction vertical to the sheet-conveying direction that is also referred to as a sheet-width direction) by the jogger fence 53. The corner stapler S10 is driven based on a staple signal from a controller 350 (see FIG. 15) during an interval between jobs, that is, an interval between a time when a last sheet of a stack of sheets (or sheet stack) P is stacked and a time when a first sheet of a subsequent stack of sheets is stacked to perform binding processing. The sheets to which the binding processing is performed are sent to the shift discharging rollers 6 at once by a discharging belt 52 on which discharging nails 52*a* are mounted in a protruding manner and are discharged to the shift tray 202 set at a receiving position.

A home position of the discharging nail 52*a* is detected by a discharging belt home position (HP) sensor 311. The discharging belt HP sensor 311 is turned on and off by the discharging nail 52*a* arranged on the discharging belt 52. Two discharging nails 52*a* arranged on an outer periphery of the discharging belt 52 are opposed to each other. Stacks of sheets accommodated in the staple processing tray F are alternately conveyed by the discharging belt 52. The discharging belt 52 is reversely rotated as needed. Then, leading edges of the sheets accommodated in the staple processing tray F can be aligned in a conveying direction by using rear surfaces of the discharging nail 52*a* and its opposing discharging nail 52*a* that wait to move the sheets. Thus, the discharging nail 52*a* also functions as an aligning unit to align sheets in the conveying direction.

The discharging belt 52 and its driving pulley are arranged with respect to a driving shaft of the discharging belt 52 driven by a discharging motor (not shown) to align sheets in a sheet-width direction. A discharging roller 56 is arranged and fixed symmetrically to the driving pulley. A higher circumferential velocity of the discharging roller 56 is set than that of the discharging belt 52.

The tapping roller 12 swings like a pendulum about its fulcrum by a tapping solenoid (SOL), which intermittently acts on sheets conveyed to the staple processing tray F, so that the sheets hit a rear end fence 51. The tapping roller 12 rotates counterclockwise. The jogger fence 53 is driven via a timing belt by a jogger motor (not shown) that can rotate in a normal direction or its reverse direction and reciprocates in a sheet-width direction.

The corner stapler S10 is driven via the timing belt by a stapler moving motor (not shown) that can rotate in a normal direction or its reverse direction and moves in the sheet-width direction to bind a predetermined position in corners of sheets. A stapler moving HP sensor that detects a home position of the corner stapler S10 is arranged at an end of a range in which the sensor moves. A position to bind sheets in the sheet-width direction is controlled based on a distance by which the corner stapler S10 moves from the home position. The corner stapler S10 can staple sheets with a pin so that the pin is in parallel with the sheets or at an angle to the corner of the sheets, and only a binding mechanism of the corner stapler S10 can be rotated at its home position askew by a predetermined angle to easily exchange the staple pin. In other words, the corner stapler S10 is rotated askew by a slanting motor. When a pin exchanging position sensor detects that the corner stapler S10 is rotated askew by a predetermined angle or that it reaches a position to exchange the staple pin, the slanting motor stops. When the corner stapler S10 finishes sticking pins in the slanting direction or exchanging pins, it rotates and returns to its original position and is ready for next stapling. A sheet detecting sensor 310 detects the presence or absence of a sheet on the staple processing tray F shown in FIG. 1.

As shown in FIGS. 1, 2, 5 to 7, a sheet turning mechanism includes a conveying mechanism 600 by which a conveying force is applied to sheets, the discharging roller 56 for turning sheets, and the guiding member 609 integrally formed as one member to guide a turning unit for sheets. The discharging roller 56 is arranged above the staple processing tray F and the guiding member 609 is arranged on a side of an outer periphery of the discharging roller 56.

Figure 2:
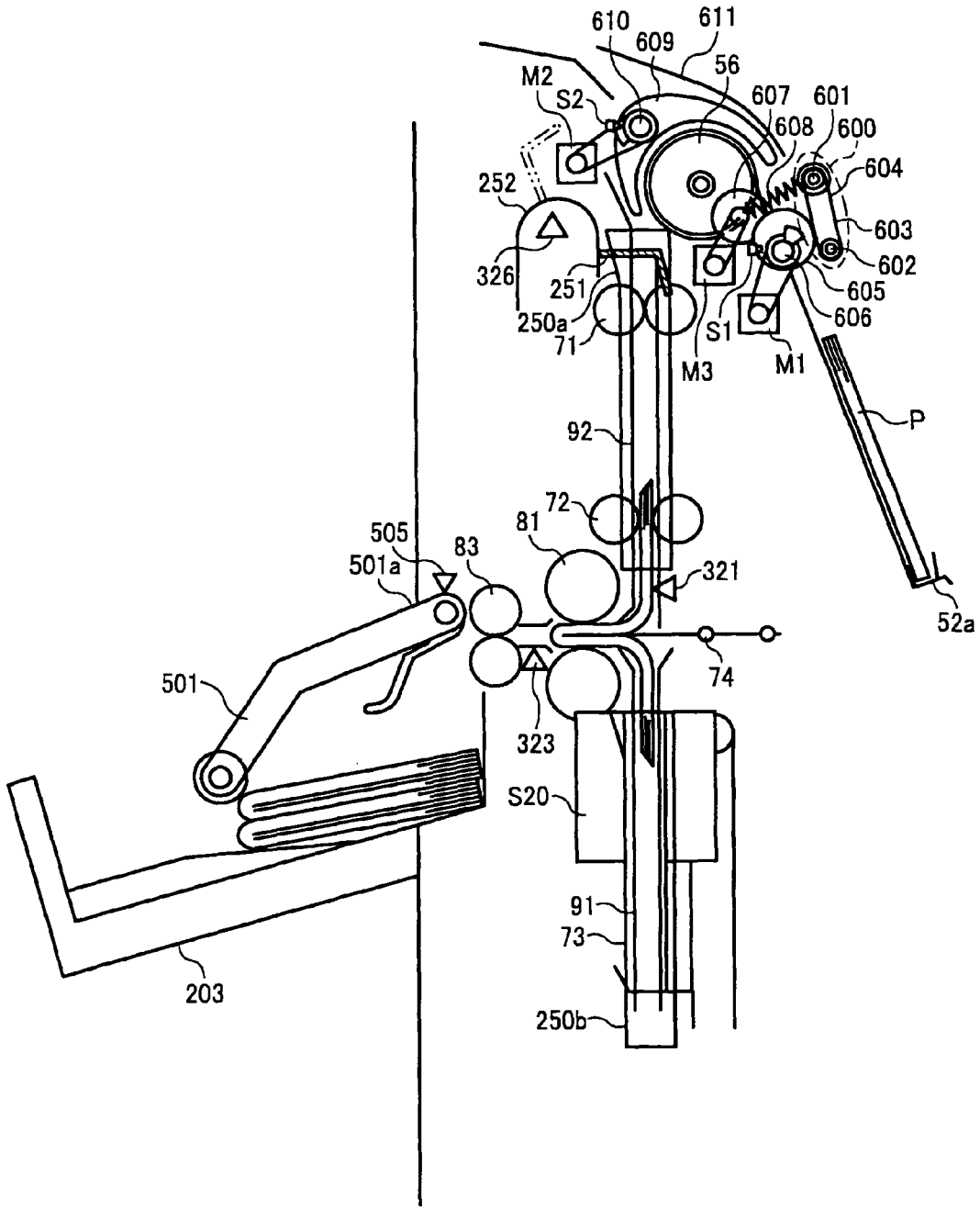
FIG. 2 is an enlarged view of a relevant part of a staple processing tray and a folding processing tray shown in FIG. 1.

As shown in FIG. 2, a driving force of a driving shaft 602 is transmitted through a timing belt 603 to a roller 601 of the conveying mechanism 600. The roller 601 and the driving shaft 602 are coupled and supported by an arm 604 and can be rotated about the driving shaft 602 as a rotating fulcrum. The roller 601 rotates (positional movement) based on movement of a cam 605. The cam 605 rotates about a rotation shaft 606 and is driven by a motor M1. A sensor S1 detects a home position of the cam 605 that rotates and moves the conveying mechanism 600. A sensor S2 detects a home position of the guiding member 609. An angle at which the guiding member 609 rotates from its home position can be controlled by additional sensor shown in FIG. 2 or adjusted based on pulse control from the motor M1. A driven roller 607 is arranged opposed to the roller 601. Sheets P are put between the driven roller 607 and the roller 601 and are pressed by an elastic member 608 formed of a pulling spring, for example. Therefore, a conveying force is transmitted to the sheets.

Figure 3:
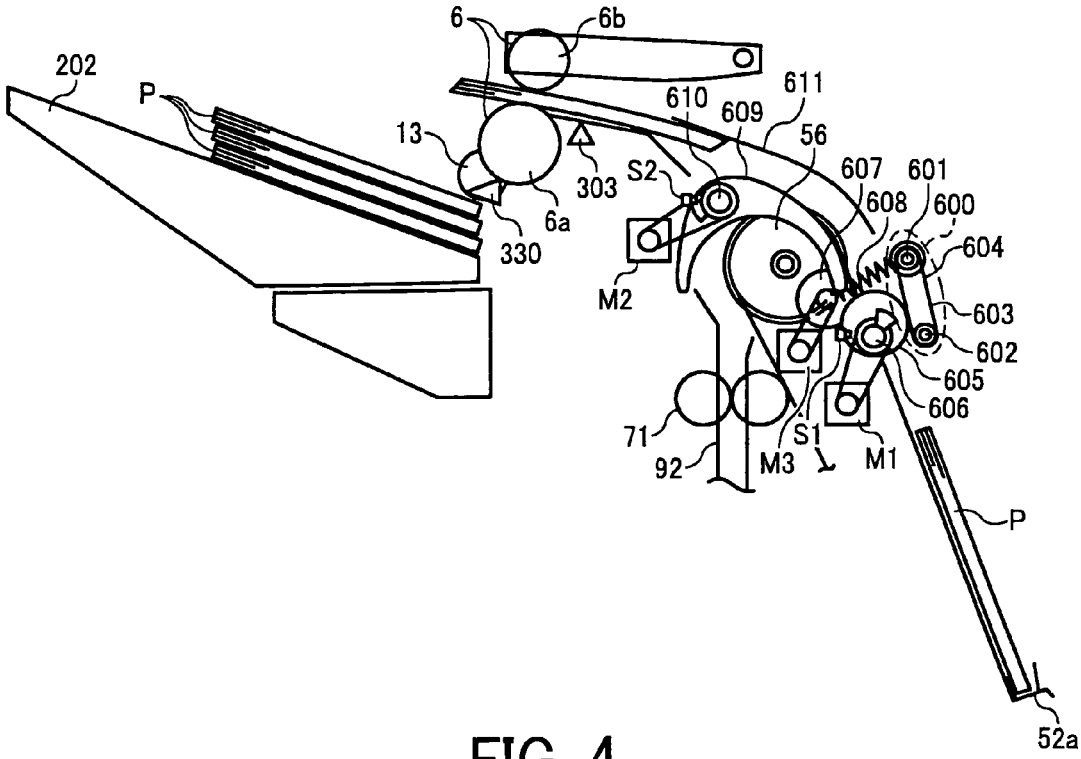
FIG. 3 is a schematic diagram for explaining a relation among a roller, a discharging roller, and a stack of sheets in a conveying mechanism shown in FIG. 2.
Figure 5:
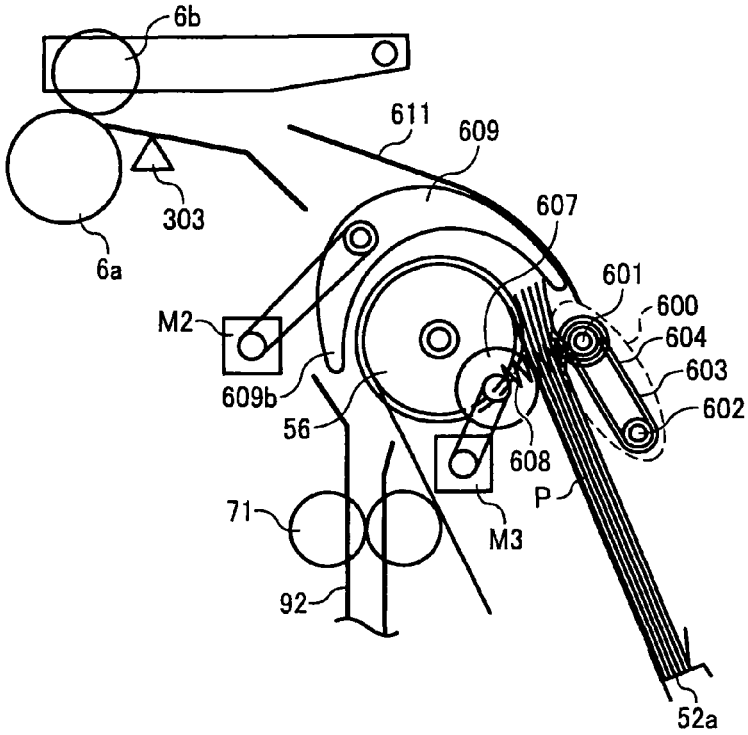
FIG. 5 is a schematic diagram for explaining a state of a turning conveying unit when the sheets to be conveyed to a saddle-stitching tray enter the turning conveying unit.

A conveying path on which sheets P are conveyed from the staple processing tray F to the folding processing tray G is formed between the discharging roller 56 and the guiding member 609. When the sheets P are conveyed to the folding processing tray G, as shown in FIG. 5, the guiding member 609 is rotated counterclockwise and leading edges of the sheets P are directed to a conveying path (a turning conveying path) formed between a curved inner surface of the guiding member 609 and the discharging roller 56. When the sheets P are conveyed to the shift tray 202, as shown in FIG. 3, the guiding member 609 is rotated clockwise and leading edges of the sheets P are directed to a conveying path formed between a rear surface of the curved surface of the guiding member 609 and a guiding plate 611.

An explanation is next given about the guiding member 609 that is formed of two members. As shown in FIGS. 8 to 14, the sheet turning mechanism includes the conveying mechanism 600 in which a conveying force is applied to sheets, the discharging roller 56 for turning sheets, and a first guiding member 609*a* and a second guiding member 609*b* for guiding the turning unit for sheets. The discharging roller 56 is arranged above the staple processing tray F and the first and second guiding members 609*a* and 609*b* are arranged on the side of the outer periphery of the discharging roller 56.

Each of the guiding members 609*a* and 609*b* is explained in the same manner as in the case in which the guiding member is integrally formed as one member except that the guiding member is formed of two members. The conveying path on which sheets P are conveyed from the staple processing tray F to the folding processing tray G is formed of the discharging roller 56, the first guiding member 609*a*, and the second guiding member 609*b* both of which are opposed to the discharging roller 56. The first guiding member 609*a* is arranged at an upstream in a sheet-conveying direction and the second guiding member 609*b* is arranged at a downstream in the sheet-conveying direction. The first guiding member 609*a* and the second guiding member 609*b* rotate about the same fulcrum 610 and are driven by the motors M2*a* and M2*b*, respectively. Home positions of the first guiding member 609*a* and the second guiding member 609*b* are detected by two sensors (not shown) mounted on the same position as the sensor S2. The conveying path on which sheets P are conveyed from the staple processing tray F to the shift tray 202 serving as a stack unit is formed of the rear surface of the curved surface of the first guiding member 609*a* and the guiding plate 611 (shown in FIG. 9) while the first guiding member 609*a* rotates clockwise about the fulcrum 610.

Saddle stitching and center folding are performed in the folding processing tray G mounted on a downstream of the staple processing tray F. Sheets P are directed from the staple processing tray F to the folding processing tray G through the sheet turning mechanism.

As shown in FIGS. 1 and 2, the folding processing tray G is vertically arranged at a downstream of the sheet turning mechanism. The folding processing tray G includes a center folding mechanism at its center, an upper guide plate 92 located above the center folding mechanism, and a lower guide plate 91 located below the center folding mechanism. Upper conveying rollers 71 are arranged at an upper portion of the upper guide plate 92 and lower conveying rollers 72 are arranged at a lower portion of the upper guide plate 92. The saddle-stitching upper jogger fence 250*a* is arranged to extend across both of the conveying rollers 71 and 72 and along both sides of the upper guide plate 92. The saddle-stitching lower jogger fence 250*b* is likewise arranged along both sides of the lower guide plate 91. The saddle-stitching stapler S20 is arranged on the saddle-stitching lower jogger fence 250*b*. The saddle-stitching upper jogger fence 250*a* and the saddle-stitching lower jogger fence 250*b* that are driven by a driving mechanism (not shown) perform alignment operations with respect to sheets in a direction vertical to a sheet-conveying direction. The saddle-stitching stapler S20 includes two pairs of a clincher and a driver arranged at a predetermined space between both pairs in the sheet-width direction. In this case, both of the two pairs are fixed but two-position binding can be performed by moving one of the pairs in the sheet-width direction.

A movable rear end fence 73 that is arranged across the lower guide plate 91 can be moved in the sheet-conveying direction (a vertical direction in FIGS. 1 and 2) by a moving mechanism that includes a timing belt and its driving mechanism. As shown in FIG. 1, the driving mechanism includes a driving pulley and a driven pulley over which the timing belt is stretched and a stepping motor that drives the driving pulley. A rear end tapping nail 251 and its driving mechanism are arranged at an upper portion of the upper guide plate 92. The rear end tapping nail 251 can reciprocate between a direction away from the sheet turning mechanism and a direction in which trailing edges of sheets (when sheets are entered toward the folding processing tray G) are pressed by a timing belt 252 and its driving mechanism (not shown). A home position sensor 326 detects a home position of the rear end tapping nail 251 shown in FIG. 1.

The center folding mechanism arranged substantially at a center of the folding processing tray G includes the folding plate 74, the folding rollers 81, and a conveying path H that is used to convey folded sheets.

The folding plate 74 is supported by fitting two shafts that protrude on a front side plate and a rear side plate (not shown) into two long holes of the folding plate 74, so that there is a space between the shaft and the hole which enables movement of the shafts. A shaft of the folding plate 74 that is arranged in a standing condition is fitted into a long hole of a link arm, so that there is a space between the shaft and the hole which enables movement of the shaft. Thus, the folding plate 74 horizontally reciprocates by rotating the link arm about a fulcrum of the link arm shown in FIG. 1. In other words, a shaft of a folding plate driving cam is fitted into a long hole of the link arm, so that there is a space between the shaft and the hole which enables movement of the shaft. The link arm rotates based on rotation of the folding plate driving cam.

Therefore, as shown in FIG. 1, the folding plate 74 reciprocates vertically with respect to the lower guide plate 91 and the upper guide plate 92.

When center folding is performed, it is assumed that sheets are bound in the embodiment; however, the embodiment can be applied to a case in which one sheet is folded. In this case, it is unnecessary to perform saddle stitching with respect to only one sheet. Therefore, when one sheet is discharged, it is conveyed on a side of the folding processing tray G. Folding is performed by the folding plate 74 and the folding rollers 81, and the folded sheet is discharged to the lower tray 203 through discharging rollers 83. A folding-unit passing sensor 323 detects a sheet that is subjected to center folding.

A detecting lever 501 that detects a height of sheets stacked at the lower tray 203 that are subjected to center folding is arranged rotatably about a fulcrum 501*a*. A sheet-surface detecting sensor 505 detects an angle at which the detecting lever 501 rotates and also detects rise and fall operations of the lower tray 203 and overflow of sheets.

Figure 15:
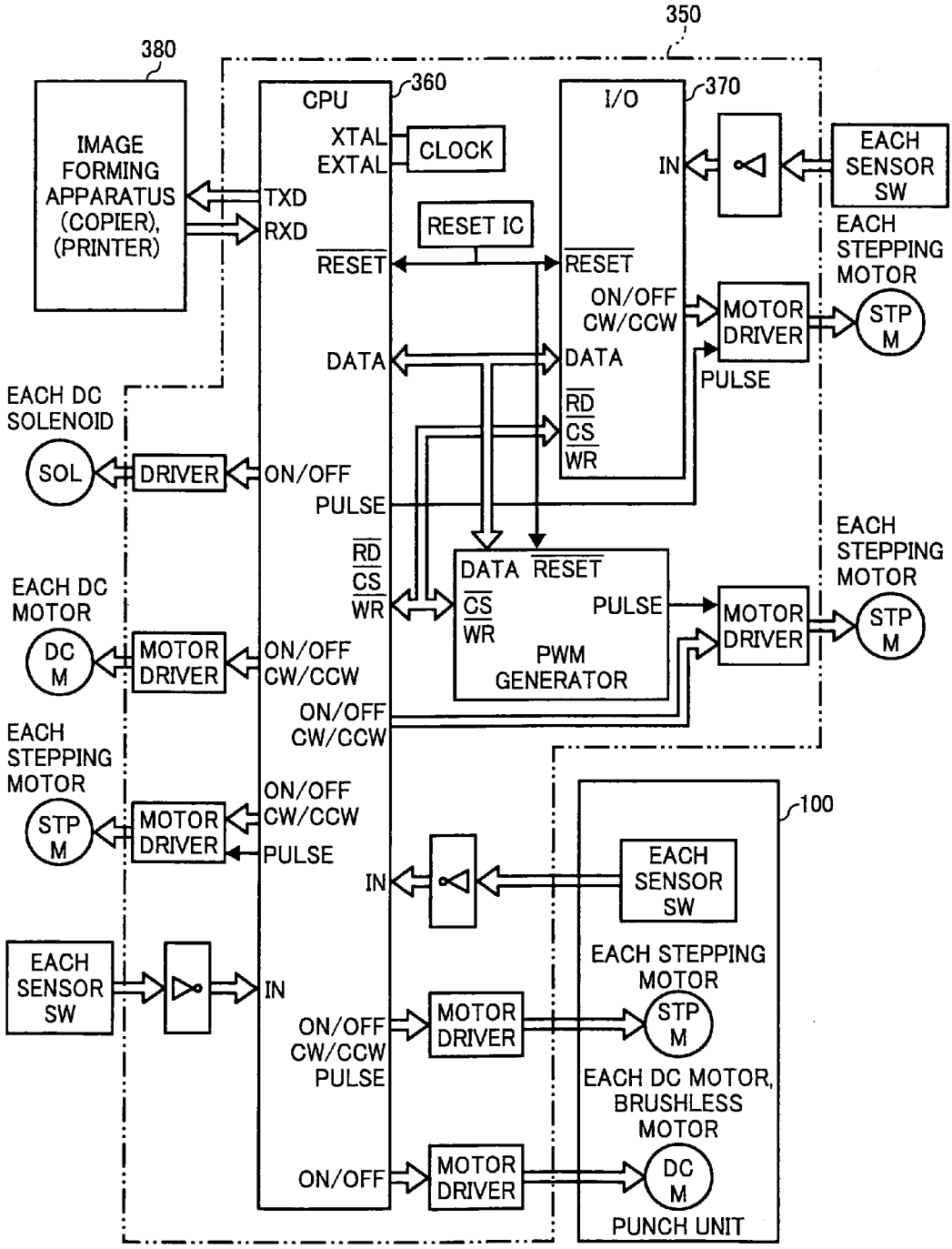
FIG. 15 is a schematic block diagram of a controller for the image forming system shown in FIG. 1.

FIG. 15 is a schematic block diagram of a controller for the system shown in FIG. 1. The controller 350 is a microcomputer that includes a central processing unit (CPU) 360, an I/O interface 370, and the like. The CPU 360 receives, through the I/O interface 370, signals from switches provided on a control panel of an image forming apparatus PR (or 380) and signals from the inlet sensor 301, an upper discharging sensor 302, a shift discharging sensor 303, a prestack sensor 304, a staple discharging sensor 305, the sheet detecting sensor 310, the discharging belt HP sensor 311, a stapler moving home position sensor, a stapler slanting home position sensor, a jogger fence home position sensor, a stack arrival sensor 321, a movable rear-end fence home position sensor 322, the folding-unit passing sensor 323, a lower discharging sensor, the sheet-surface detecting sensors 330, 505, S1, and S2.

The CPU 360 controls, based on the input signals, a tray elevating motor for elevating the shift tray 202, a discharging guide plate opening motor for opening or closing an opening guide plate, a shift motor for moving the shift tray 202, a tapping roller motor for driving the tapping roller 12, conveying motors for driving solenoids such as the tapping SOL and each of the conveying rollers, discharging motors for driving each of discharging rollers, a discharging motor for driving the discharging belt 52, a stapler moving motor for moving the corner stapler S10, a slanting motor for askew rotating the corner stapler S10, a jogger motor for moving the jogger fence 53, the motor M1 for driving the conveying mechanism 600, the motor M2 for rotating and driving the guiding member 609, a rear-end fence moving motor (not shown) for moving the movable rear-end fence 73, a folding plate driving motor for moving the folding plate 74, and a folding roller driving motor (not shown) for driving folding rollers 81.

Pulse signals for a motor (not shown) that drives the staple discharging rollers are sent to and counted in the CPU 360. The tapping SOL and the jogger motor are controlled based on the counted value of the pulse signals. The punch unit 100 performs punching sheets by controlling a clutch and a motor based on an instruction from the CPU 360. The sheet post-processing apparatus PD is controlled by the CPU 360 in which programs stored in a read only memory (ROM) (not shown) are executed while using a random access memory (RAM) (not shown) as a work area.

FIG. 2 is a schematic diagram for explaining operations when folding processing is performed by using one guiding member. Center folding is performed in the folding processing tray G and a state before stacked sheets P are conveyed is indicated in the staple processing tray F. When the sheets P are conveyed from the staple processing tray F to the folding processing tray G, trailing edges of the sheets P that are aligned by the rear-end fence 51 and the jogger fence 53 in the staple processing tray F are pushed up by the discharging nail 52*a*, and the roller 601 and the driven roller 607 corresponding thereto located at an upper portion of the staple processing tray F catch the sheets P to apply a conveying force to the sheets. In this case, the roller 601 located on a side of leading edges of the sheets waits in such a way not to hit leading edges of the sheets P. After the leading edges of the sheets P are passed, the roller 601 comes into contact with a surface of the sheets to apply a conveying force to the sheets. The conveying path of the turning unit is formed of an inner surface of a curved portion of the guiding member 609 and the outer peripheral surface of the discharging roller 56. The sheets are conveyed along the conveying path to the folding processing tray G located at a downstream.

When a stack of sheets are conveyed from the staple processing tray F to the shift tray 202, as shown in FIG. 3, the guiding member 609 is rotated clockwise and the conveying path leading to the shift tray 202 is formed of a rear surface (an outer peripheral surface) of the curved portion of the guiding member 609 and the guiding plate 611. Trailing edges of the sheets P that are aligned in the staple processing tray F are pushed up by the discharging nail 52*a* and the sheets are conveyed to the shift tray 202 (see FIGS. 2 and 6). The discharging roller 56, whether it is a driving roller driven by a motor or a driven roller followed by conveyance of the sheets without being driven by a motor, can cause the sheets to turn and to convey to the folding processing tray G or the shift tray 202.

FIG. 5 is a schematic diagram of a relevant part of the sheet turning unit. When sheets are conveyed from the staple processing tray F to the folding processing tray G, leading edges of the sheets may be misaligned. In that case, the sheets P can not be reliably conveyed to the conveying path in a position shown in FIG. 2, which may cause a sheet jam at an edge of the guiding member 609. Therefore, according to the embodiment, as shown in FIG. 5, an opening area of the guiding member 609 to reliably convey leading edges of the sheets to the conveying path between the inner surface of the curved portion of the guiding member 609 and the discharging roller 56 is secured. When the sheets protrudes out of a nip between the roller 601 and the driven roller 607, the sheets are reliably brought into contact with the inner surface of the curved portion of the guiding member 609 and the guiding member 609 is rotated until the sheets turn along the conveying path. This makes it possible to prevent jam from occurring at an entrance to the conveying path.

Figure 6:
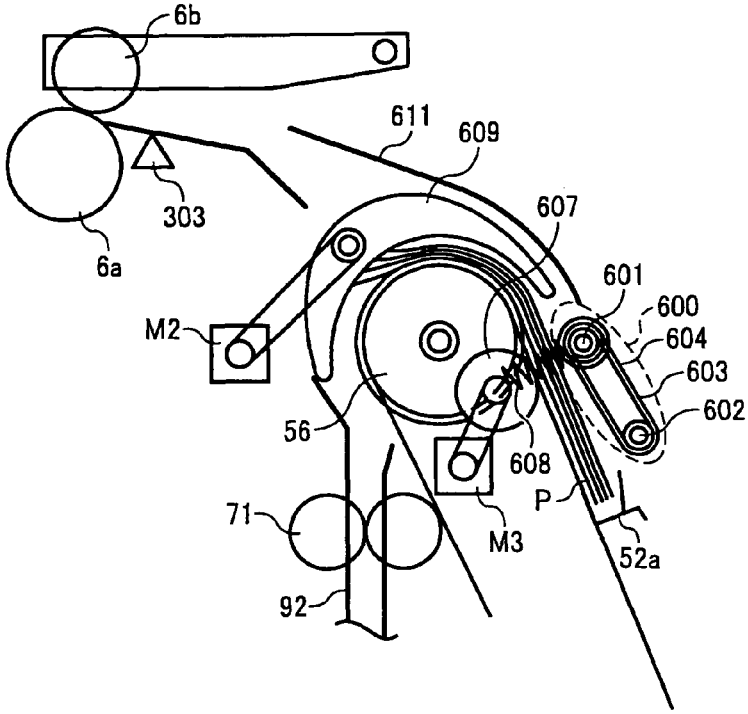
FIG. 6 is a schematic diagram for explaining a state of conveying sheets in the turning conveying unit when the sheets are conveyed to the saddle-stitching tray.

When the sheets P enter into the conveying path furthermore from a state shown in FIG. 5 and the leading edges of the sheets P reach near a center of the inner surface of the curved portion of the guiding member 609, the guiding member 609 is rotated clockwise shown in FIG. 6. This makes it possible to have a larger space between the inner surface of the curved portion of the guiding member 609 and the outer peripheral surface of the discharging roller 56. Therefore, the leading edges of the sheets P turn along the curved portion and a curvature when the sheets P are conveyed becomes small. Consequently, conveyance resistance becomes small when the sheets are conveyed, and improvement is performed in conveying sheets P along the conveying path.

Figure 7:
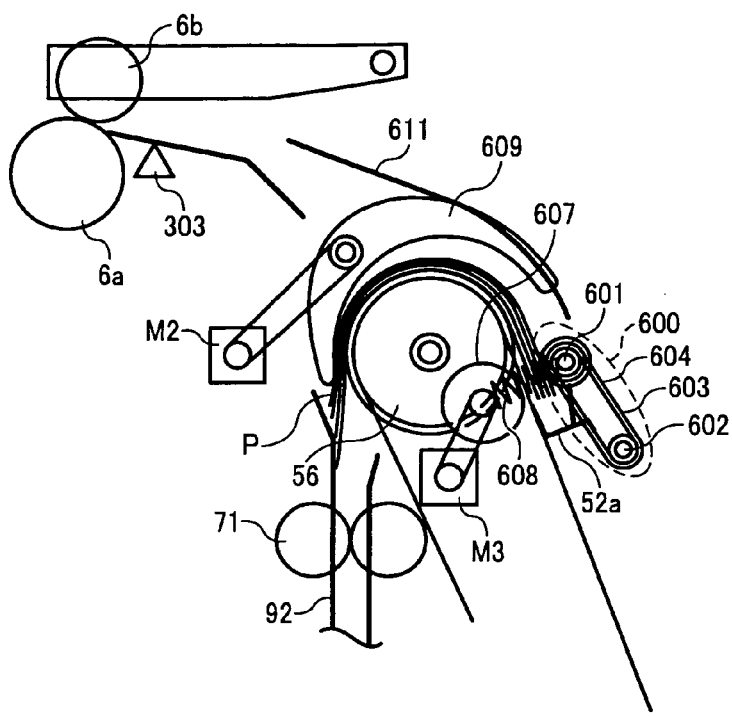
FIG. 7 is a schematic diagram for explaining a state in which the sheets are discharged from the turning conveying unit to the saddle-stitching tray.

While the sheets P are conveyed furthermore from a state shown in FIG. 6 and the leading edges of the sheets P reach a position in which they enter the upper guide plate 92 shown in FIG. 7, the guiding member 609 is rotated counterclockwise. Accordingly, the leading edges of the sheets P reliably enter into the upper guide plate 92 shown in FIG. 7. This makes it possible to reliably pass the sheets P to the upper conveying rollers 71 at a downstream by the guiding member 609.

Next, an explanation is given about an example in which the guiding member 609 is formed of a first guiding member 609*a* and a second guiding member 609*b*. The first guiding member 609*a* and the second guiding member 609*b* can separately rotate about the common fulcrum 610. The operation of this example is basically the same as in the example in which the guiding member 609 is formed of one guiding member. When sheets are conveyed to the folding processing tray G after the sheets are aligned in the staple processing tray F, the first guiding member 609*a* is rotated counterclockwise to form the conveying path between the first guiding member 609*a* and the discharging roller 56, thereby the sheets are turned and guided to the folding processing tray G. In addition, when sheets are conveyed to the shift tray 202 after the sheets are aligned in the staple processing tray F, the first guiding member 609*a* is rotated clockwise, so that the conveying path is changed to the conveying path to the shift tray 202 (see FIGS. 3 and 8).

Figure 4:
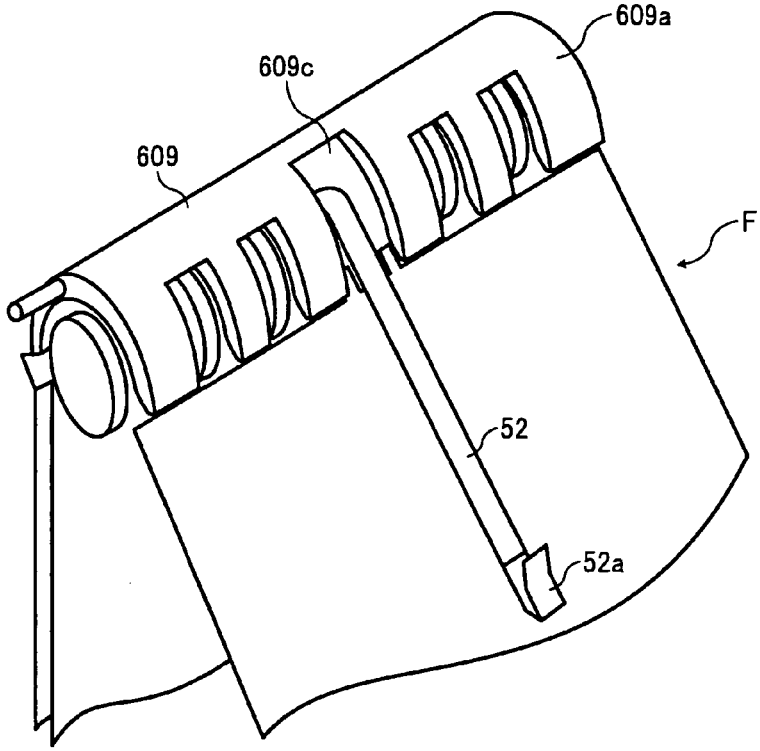
FIG. 4 is a perspective view of a guiding member in the conveying mechanism shown in FIG. 3 and the staple processing tray.

Sheets P that are aligned in the staple processing tray F are pushed up to the downstream with trailing edges thereof supported by the discharging nail 52*a*. Therefore, to reliably convey the sheets P to the folding processing tray G at the downstream, it is necessary to support and pushed up the sheets P by the discharging nail 52*a* until leading edges of the sheets P reach a conveying unit at the downstream (upper conveying rollers 71 in this embodiment) or until a position in which the sheets P do not return due to their own weight even if the sheets P are not supported by the discharging unit 52. As shown in FIG. 4, an opening 609*c* that enables passing of the discharging nail 52*a* is arranged on a guiding surface of the first guiding member 609*a* to prevent the discharging nail 52*a* and the guiding member 609 (the first guiding member 609*a* in FIG. 4) from interfering with each other.

Figure 8:
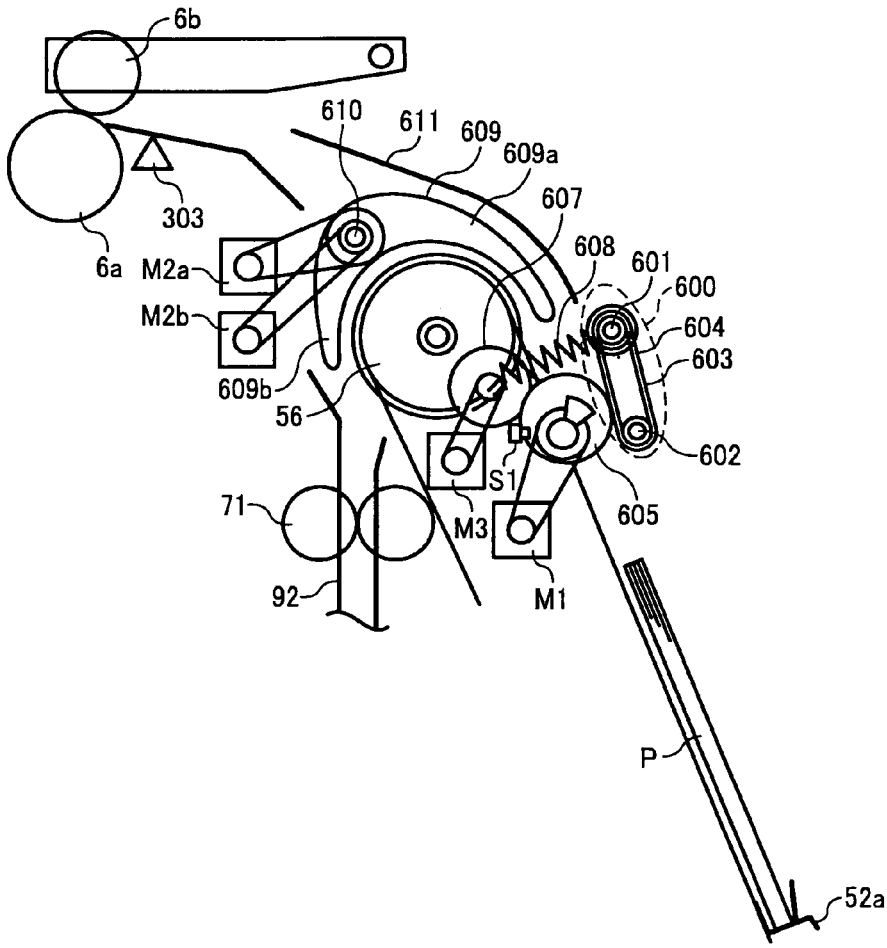
FIG. 8 is a schematic diagram for explaining an initial position of a first and a second guiding member.
Figure 9:
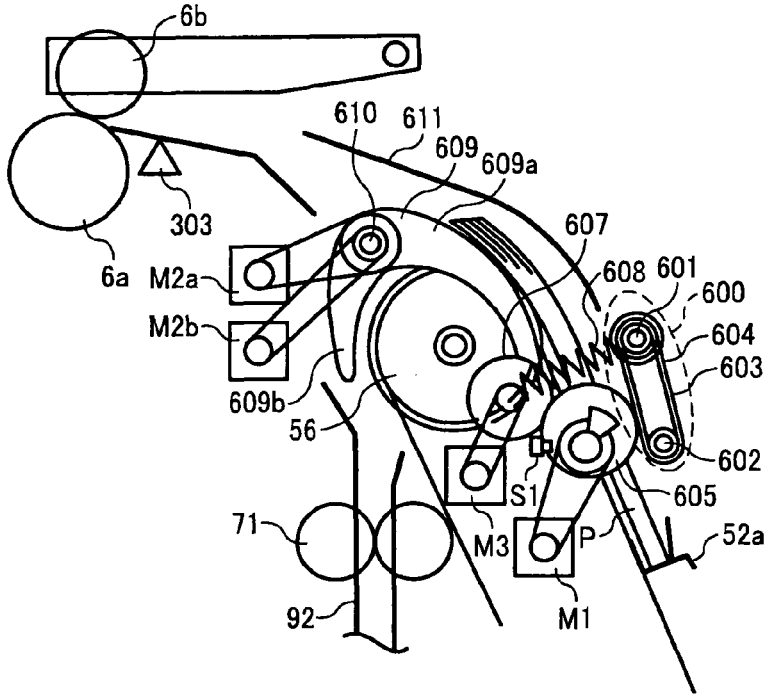
FIG. 9 is a schematic diagram for explaining a state in which, following a state in FIG. 8, the sheets are conveyed to a shift tray side.

Meanwhile, when the conveying path is changed by rotating the guiding member 609, it is impossible to arrange another component in a rotating position of the guiding member 609. As shown in FIG. 8, therefore, the guiding member 609 is divided into a plurality of components (the first and second guiding members 609*a* and 609*b*). The first guiding member 609*a* located at an upstream in the sheet-conveying direction is at least driven by the driving motor M2*a*, so that one relevant part required to change the conveying path (the first guiding member 609*a* located at an upstream of the fulcrum 610) can be moved. In this case, when the other guiding member 609*b* at a downstream is constituted not to change in position, the entire guiding member can be driven by one driving motor M2, which reduces an increase of cost.

As constituted above, an operation range of the first guiding member 609*a* when the first guiding member 609*a* is rotated can be reduced and the whole conveying unit can be compact. The second guiding member 609*b* can be rotated about the fulcrum 610 by the motor M2*b* and has a particular function in the embodiment, as described later.

Figure 10:
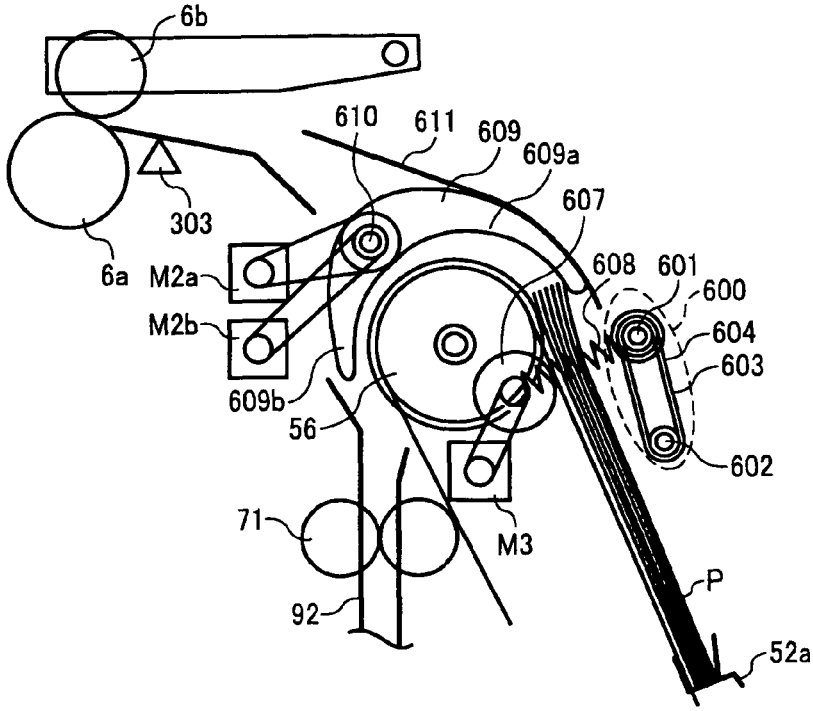
FIG. 10 is a schematic diagram for explaining a state in which, following the state in FIG. 8, the sheets are conveyed to a saddle stitching tray side.

A height or thickness of leading edges of sheets P changes depending on the number of sheets that are conveyed or curling that occurs to the sheets. Generally, the more sheets, the higher the height of leading edges of sheets. Therefore, as shown in FIG. 10, the first guiding member 609*a* is furthermore rotated from a position of the first guiding member 609*a* shown in FIG. 8 to provide a state in which leading edges of the sheets are easy to be accepted in the first guiding member 609*a*. This makes it possible to easily accept leading edges of the sheets into the conveying path between the first guiding member 609*a* and the discharging roller 56.

Figure 11:
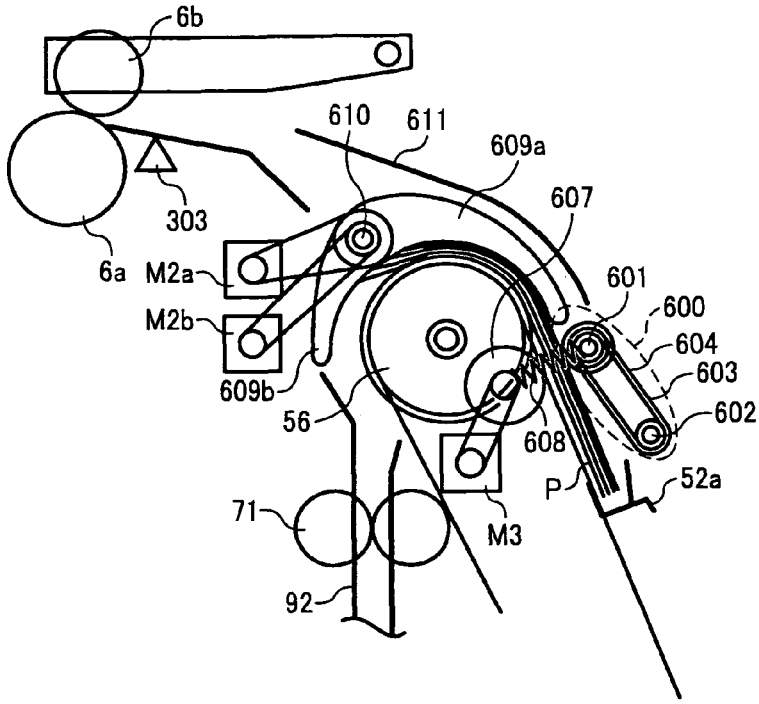
FIG. 11 is a schematic diagram for explaining a state in which, following the state in FIG. 10, the sheets are furthermore conveyed.

When the sheets P are turned and conveyed by the guiding member 609, as shown in FIG. 11, the first guiding member 609*a* is rotated slightly more clockwise than in a position shown in FIG. 10 and the second guiding member 609*b* is rotated to have a smaller curvature. This makes it possible to reduce conveyance resistance when the sheets are turned and conveyed. Moreover, when it is desired to reduce conveyance resistance, a curvature of the curved shape of the conveying path formed along the first and second guiding members 609*a* and 609*b* may be reduced as a whole by also rotating the first guiding member 609*a* counterclockwise.

After leading edges of the sheets are turned and conveyed along the inner surface (a guiding surface) of the curved portion of the first and second guiding members 609*a* and 609*b*, while the leading edges of the sheets conveyed to the folding processing tray G at the downstream enter into the upper guide plate 92 serving as a guide, the second guiding member 609*b* is rotated to set it to a position in which the leading edges of the sheets can be passed to the downstream, which reliably conveys the sheets P to the folding processing tray G at the downstream.

When the sheets are passed from the turning conveying unit to the downstream, a space to guide the sheets in the second guiding member 609*b* when the sheets are passed is smaller than that set by default shown in FIG. 8. When the sheets are conveyed as they are, conveyance resistance may occur. Therefore, after completing passing the leading edges of the sheets, the second guiding member 609*b* is returned again to a position set by default shown in FIG. 8 to convey the sheets P. Then, this makes it possible to reduce conveyance resistance to which the sheets P are subjected since then. The position set by default shown in FIG. 8 is a position in which the sheets P are accepted by the conveying unit and conveyed.

Figure 13:
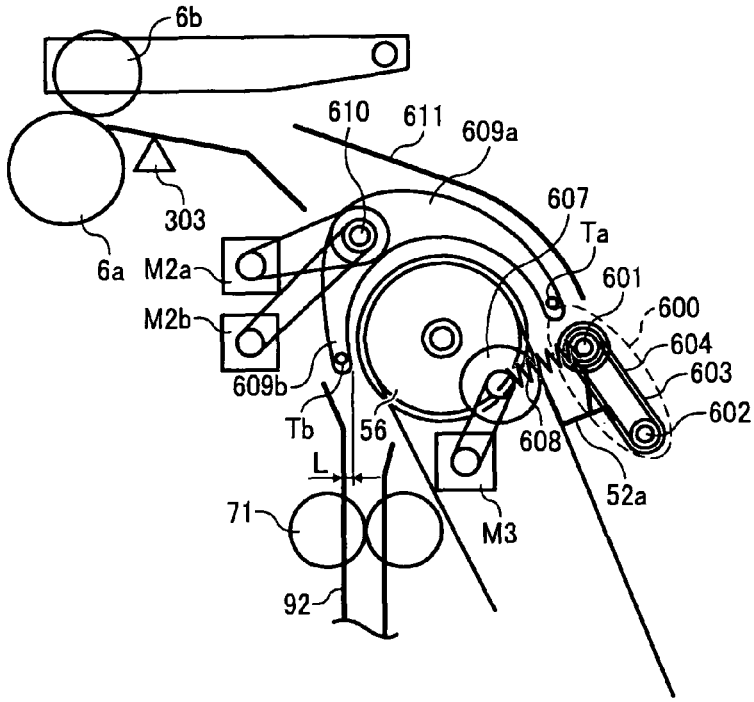
FIG. 13 is a schematic diagram for explaining knobs by which the first and the second guiding members are operated.

As described above, a height of leading edges of sheets changes based on the number of the sheets that are conveyed. Particularly, when curling occurs in leading edges of sheets, because the larger number of sheets, the higher the height of the leading edges of the sheets, if the first guiding member 609*a* has a larger rotating angle as the number of sheets increases, it is possible to easily accept the sheets when they enter. If the second guiding member 609*b* has a larger rotating angle in such a way to reduce a curvature of the turning conveying unit when the leading edges of the sheets pass the first and second guiding members 609*a* and 609*b*, it is possible to reduce conveyance resistance to which the sheets are subjected. When the leading edges of the sheets are conveyed from the second guiding member 609*b* to the downstream, as shown in FIG. 13, the rotating angle of the second guiding member 609*b* is increased and a difference L between the upper guide plate 92 and the second guiding member 609*b* is increased, so that even the sheets that have a large curling can be reliably passed to the downstream.

As described above, when curling occurs, a curled amount of the whole sheets is inclined to increase. Therefore, when a thick sheet is included in sheets P, it is determined that a large amount of curling occurs to the sheets P. If the first guiding member 609*a* has a larger rotating angle, it is possible to easily accept the sheets when they enter into the conveying path. When leading edges of the sheets pass the first and second guiding members 609*a* and 609*b*, a rotating angle of the second guiding member 609*b* is increased to reduce a curvature in the turning conveying unit. Thus, it is possible to reduce conveyance resistance to which the sheets P are subjected. In addition, when leading edges of sheets P are conveyed from the second guiding member 609*b* to the downstream, it is possible to reliably pass even sheets in which large curling occurs by increasing the rotating angle of the second guiding member 609*b* and a difference between the upper guide plate 92 and the second guiding member 609*b*.

The larger ratio of printed images is provided to sheets that are conveyed for each stack of sheets, the larger curling generally occurs to the sheets. When an area occupied by printed images with respect to the sheets is larger than its predetermined value, it is determined that a larger amount of curling occurs to the sheets P, so that the rotating angle of the first guiding member 609*a* is increased. Thus, it is possible to easily accept the sheets when they enter into the conveying path. When leading edges of the sheets are passing the first and second guiding members 609*a* and 609*b*, a rotating angle of the second guiding member 609*b* is increased to reduce a curvature of the conveying path. This makes it possible to reduce conveyance resistance to which the sheets P are subjected. In addition, when leading edges of the sheets P are conveyed from the second guiding member 609*b* to the downstream, it is possible to reliably pass even sheets to which large curling occurs by increasing the rotating angle of the second guiding member 609*b* and a difference L between the upper guide plate 92 and the second guiding member 609*b* (FIG. 13).

Figure 14:
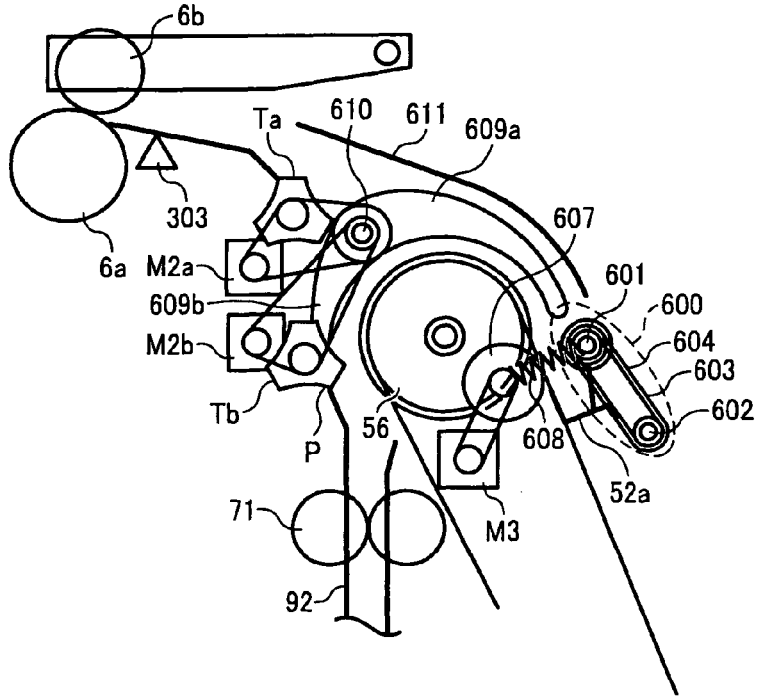
FIG. 14 is a schematic diagram for explaining another type of knobs by which the first and the second guiding members are operated.

As described above, even when some measures have been taken with respect to a jam, it is necessary to take another measure in case a jam occurs. Therefore, when a sheet jam occurs, a user can manually move the first guiding member 609*a* or the second guiding member 609*b* and remove sheets P out of the conveying path in the embodiment. Therefore, knobs Ta and Tb are mounted on the first guiding member 609*a* and the second guiding member 609*b*, respectively. As shown in FIG. 14, alternatively, a driving system for each of the first guiding member 609*a* and the second guiding member 609*b* is operated by using the knobs Ta and Tb, so that a user can operate the first guiding member 609*a* or the second guiding member 609*b* by operating the driving system and easily remove jammed sheets from the turning conveying unit.

Figure 16A:
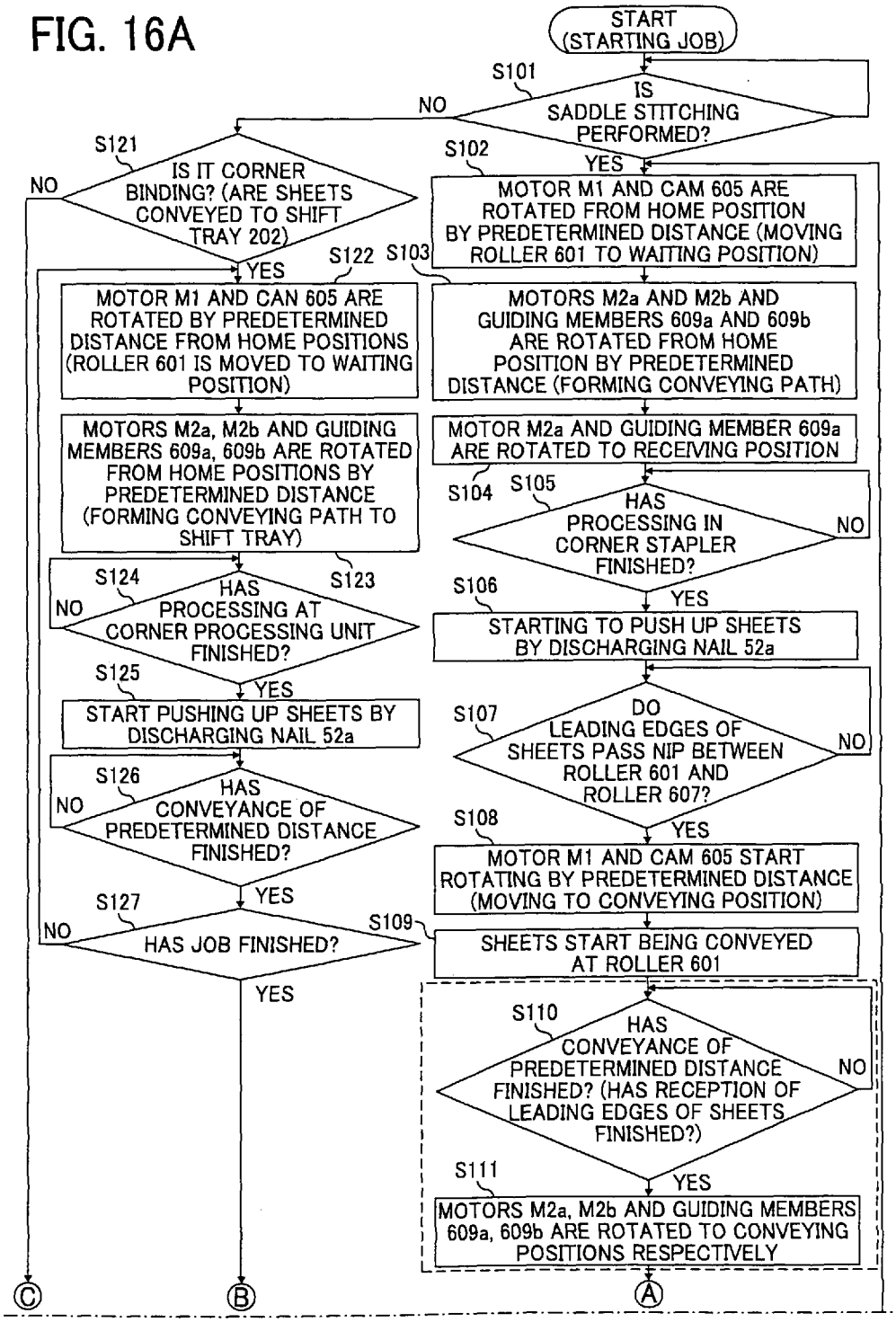
FIG. 16A is a flowchart for explaining part of an entire controlling procedure performed by the sheet post-processing apparatus according to the embodiment.
Figure 16B:
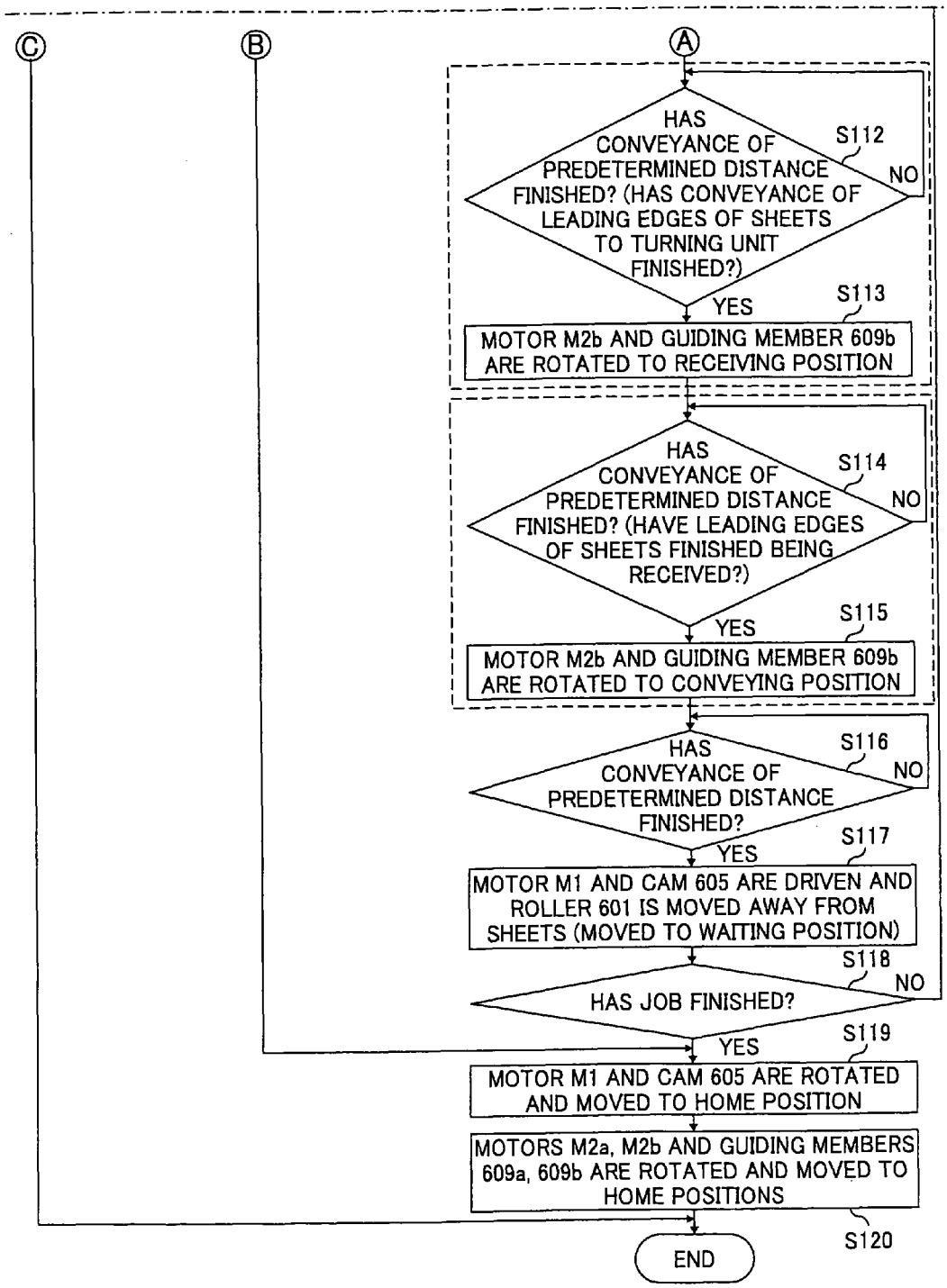
FIG. 16B is a flowchart for explaining the other part of the entire controlling procedure performed by the sheet post-processing apparatus according to the embodiment.

FIGS. 16A and 16B are flowcharts for explaining one whole controlling procedure performed by the sheet post-processing apparatus PD in which the guiding member 609 is formed of two components according to the embodiment.

As shown in FIG. 16A, when a job starts, it is checked whether saddle stitching is performed (step S101). When saddle stitching is performed, the motor M1 and the cam 605 are rotated from their home positions by a predetermined distance and the roller 601 is moved to a waiting position (step S102). The motors M2*a* and M2*b* are driven to rotate the first and the second guiding members 609*a* and 609*b* from their home positions by a predetermined distance to form the conveying path (step S103). The motor M2*a* is driven to rotate the first guiding member 609*a* to a position at which the sheets are accepted (a first position) (step S104 shown in FIG. 10). The sheets enter into the staple processing tray F where alignment of the sheets P in the conveying direction by using the rear end fence 51 and alignment of the sheets in a direction vertical to the conveying direction by using the jogger fence 53 are repeated for each of conveyed sheets. A system control waits for conveyance of a final sheet of conveyed sheets and finishing an alignment operation of the sheets (step S105).

When the alignment operation finishes (Yes at step S105), an operation of pushing up the sheets by using the discharging nail 52*a* starts (step S106 shown in FIG. 10). When leading edges of the sheets P pass a nip between the roller 601 and the driven roller 607 and reach an entrance to the conveying path between the first guiding member 609*a* and the discharging roller 56 (step S107 shown in FIG. 10), the motor M1 is driven to start rotating the cam 605 by a predetermined distance to a predetermined conveying position and the sheets P are inserted between the roller 601 and the driven roller 607 (step S108). Under this state, the roller 601 is driven by the motor M3 and the sheets P are conveyed (step S109).

The sheets P are conveyed by a predetermined distance and leading edges of the sheets P reach a predetermined position between the first guiding member 609*a* and the discharging roller 56. After acceptance of the sheets P between both of them finishes (step S110), the motors M2*a* and M2*b* are driven to rotate the first and the second guiding members 609*a* and 609*b* to their conveying positions, respectively (step S111 shown in FIG. 11), and conveyance of the sheets P continues.

Figure 12:
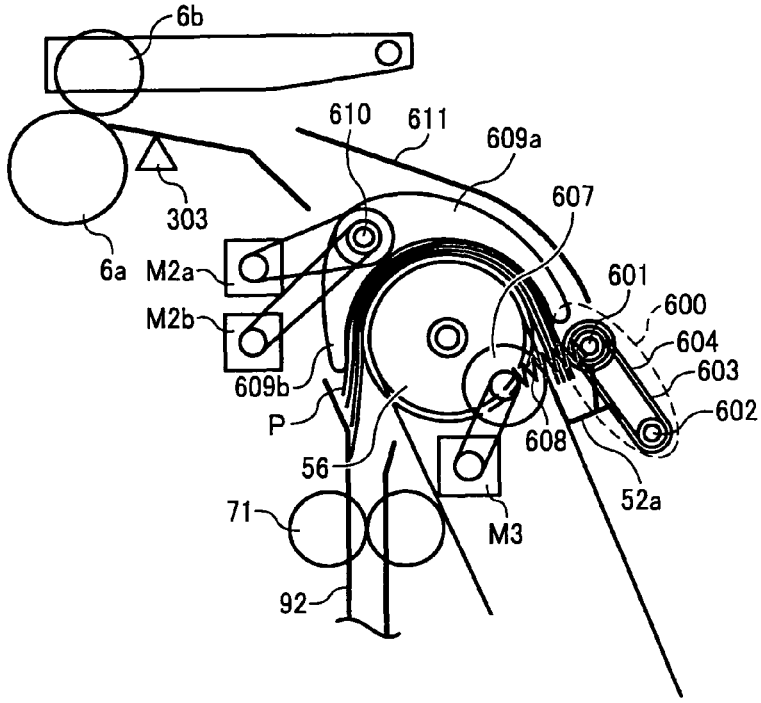
FIG. 12 is a schematic diagram for explaining a state in which, following the state in FIG. 11, the sheets are furthermore conveyed and leading edges of the sheets reach an inlet of the saddle stitching tray.

When leading edges of the sheets P reach a position of the conveying path at which conveyance of the sheets finishes (step S112), the motor M2*b* is driven to rotate the second guiding member 609*b* to a position at which the sheets P are passed to the upper guide plate 92 (step S113 shown in FIG. 12). The conveyance of the sheets continues as it is and finishes by a predetermined distance that is set as a distance to complete reliably passing leading edges of the sheets to the upper guide plate 92 (passing sheets to the upper conveying rollers 71) (step S114). Then, the motor M2*b* is driven to return the second guiding member 609*b* to the conveying position shown in FIG. 10 (step S115). At a time point when the sheets are conveyed by a predetermined distance (step S116), the cam 605 is driven by the motor M1 and the roller 601 is moved to a waiting position away from the sheets P (step S117). Then, the system control is repeated from step S101. The repetition is performed by a circulation set in a job. When the job finishes (step S118), the motor M1 is driven to rotate the cam 605, the roller 601 is moved to its home position (step S119), the motors M2*a* and M2*b* are driven to move the first and the second guiding members 609*a* and 609*b* to their home positions (step S120 shown in FIG. 8), and the system control ends.

On the other hand, when saddle stitching is not required (step S101), it is checked whether corner binding is required (step S121). When corner binding is not required, the system control ends. When corner binding is required, the motor M1 is driven to rotate the cam 605 from its home position by a predetermined distance and the roller 601 is moved to a waiting position (step S122). The motors M2*a* and M2*b* are driven to rotate the first and the second guiding members 609*a* and 609*b* from their home positions by a predetermined distance to form the conveying path to the shift tray (step S123). When the sheets P enter into the staple processing tray F, operations to align the sheets in vertical and horizontal directions are performed, and processing in the staple processing tray F ends (step S124), pushing up the sheets by the discharging nail 52*a* starts (step S125 shown in FIG. 9). Processing since step S122 is repeated until the sheets are conveyed by a predetermined distance, discharging the sheets finishes (step S126), and the job finishes. When the job finishes (step S127), the motor M1 is driven to rotate the cam 605, and the roller 601 is moved to a waiting position (step S119). In addition, the motors M2*a* and M2*b* are driven to move the first and the second guiding members 609*a* and 609*b* to their home positions (step S120), and the system control ends.

As described above, the typical roller is used as the conveying unit. However, instead of the roller, a belt can be used to obtain the same effects.

According to the embodiment, one guiding member enables processing in a plurality of sheet processors and conveyance of sheets that have finished processing to a stack unit, which leads to simplification of the guiding member.

Moreover, it is possible to reliably convey sheets to a sheet processor or a stack unit at a downstream by a discharging nail that pushes up the sheets from a sheet processor.

A smaller operation range of the guiding member significantly contributes to space saving.

Furthermore, irrespective of the number of sheets, a kind of a sheet, or an image mode printed on a sheet, sheets can be conveyed to a sheet processor or a stack unit at a downstream by using a smaller conveyance load, so that it is possible to reliably convey the sheets.

Moreover, when a sheet jam occurs near a guiding member or in the guiding member, a user can smoothly remove a jammed sheet.

Furthermore, a height of leading edges of sheets changes based on the number of sheets that are conveyed or curling that occurs to the sheets. Generally, the larger number of sheets, the higher the height of leading edges of sheets. Therefore, as shown in FIG. 5 or 10, the guiding member 609 or a first guiding member 609*a* is rotated and is set for leading edges of the sheets to be easily accepted. Consequently, it is possible for leading edges of the sheets to easily enter into the guiding member 609 or the first guiding member 609*a*.

Moreover, as shown in FIG. 11, when sheets are turned and conveyed along the first guiding member 609*a* and a second guiding member 609*b*, the first guiding member 609*a* is rotated to a conveying position and the second guiding member 609*b* is rotated to a position in which a curved portion of the second guiding member 609*b* has a smaller curvature. This makes it possible to reduce conveyance resistance when the sheets are turned and conveyed. When conveyance resistance is required to furthermore reduce, the first guiding member 609*a* is rotated to have a wider conveying path, and a curved guiding portion formed of the first guiding member 609*a* and the second guiding member 609*b* can have a smaller curvature as a whole.

Furthermore, as shown in FIG. 6, when leading edges of sheets reach near a summit of a curved portion of the guiding member 609 integrally formed as one guiding member, the guiding member 609 is rotated and located to have a wider space with a discharging roller 56 that is concentric with an inner side of the guiding member 609. Therefore, when leading edges of the sheets are conveyed along the guiding member 609, a latter half of the curved portion thereof has a smaller curvature, which reduces conveyance resistance.

Moreover, after leading edges of sheets are turned and conveyed along a curved portion of a first and a second guiding members 609*a* and 609*b*, while the leading edges of the sheets are inserted into the upper guide plate 92 serving as a guide to convey the sheets to a sheet processor at a downstream, the second guiding member 609*b* is rotated to set it to a position at which the leading edges of the sheets can be passed to the downstream, which enables reliable conveyance of the sheets to the sheet processor at the downstream.

Furthermore, as shown in FIG. 7, when a guiding member is integrally formed as one guiding member, while leading edges of sheets enter the upper guide plate 92 at a downstream, the guiding member 609 is rotated to set it to a position at which the leading edges of the sheets can be passed to the downstream, which enables reliable conveyance of the sheets to a sheet processor at a downstream.

According to the embodiments of the present invention, it is possible to reliably convey sheets on a side of a stack unit without causing interference between a guiding member and a discharging unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device that conveys a sheet, comprising:

a guiding roller that guides and conveys the sheet;

a first guiding member and a second guiding member, arranged along an outer periphery of the guiding roller, for guiding the sheet in conjunction with the guiding roller;

a supporting shaft that rotatably supports both the first guiding member and the second guiding member; and an operation unit to manually operate the first guiding member and the second guiding member when a jammed sheet is removed.

2. The sheet conveying device according to claim 1, wherein the first guiding member and the second guiding member are integrally formed as one guiding member.

3. The sheet conveying device according to claim 1, wherein when located at a first position in which a path between the first guiding member and the guiding roller is closed, the first guiding member guides the sheet to a first conveying path, and when located at a second position in which the path between the first guiding member and the guiding roller is opened, the first guiding member guides the sheet to a second conveying path.

4. The sheet conveying device according to claim 3, wherein when the sheet is guided to the second conveying path, the first guiding member is located at a third position between the first position and the second position, and the second guiding member is located at an open position to open the second conveying path while guiding the sheet to the second conveying path.

5. The sheet conveying device according to claim 3, wherein when a leading edge of the sheet is passing from the second guiding member to the second conveying path, the second guiding member is closer to the guiding roller than at the open position such that the conveying path is narrowed.

6. The sheet conveying device according to claim 5, wherein after the leading edge of the sheet passes from the second guiding member to the second conveying path, the second guiding member is located at the open position.

7. The sheet conveying device according to claim 3, wherein guiding positions of the first guiding member and the second guiding member change depending on number of the sheets.

8. The sheet conveying device according to claim 3, wherein guiding positions of the first guiding member and the second guiding member change depending on a kind of the sheet.

9. The sheet conveying device according to claim 3, wherein guiding positions of the first guiding member and the second guiding member change depending on a state of an image printed on the sheet.

10. The sheet conveying device according to claim 1, further comprising a conveying member, disposed at a position close to the first guiding member and the second guiding member, for conveying the sheet towards the guiding roller, wherein an opening is provided at part of a guiding surface of the first guiding member and the second guiding member not to interfere the conveying member.

* * * * *